US005112198A

United States Patent [19]

Skinner

[11] Patent Number: 5,112,198

[45] Date of Patent: May 12, 1992

[54] REFRIGERANT COMPRESSOR HAVING VARIABLE RESTRICTION PRESSURE PULSATION ATTENUATOR

[75] Inventor: Timothy J. Skinner, E. Amherst, N.Y.

[73] Assignee: General Motors Corporation, Detroit, Mich.

[21] Appl. No.: 652,763

[22] Filed: Feb. 8, 1991

[51] Int. Cl.[5] ..... F04B 21/00; F01N 7/10

[52] U.S. Cl. ..... 417/269; 417/222 R; 417/312; 181/403

[58] Field of Search ..... 181/403, 240; 417/269, 417/312, 313, 222, 222 S

[56] References Cited

U.S. PATENT DOCUMENTS

| | | | |
|---|---|---|---|
| 1,163,128 | 12/1915 | Bauer . | |
| 1,915,694 | 6/1933 | Reindel . | |
| 2,846,140 | 8/1958 | Kemper | 230/232 |
| 3,643,759 | 2/1972 | Bailey | 181/40 |
| 4,221,544 | 9/1980 | Ohta | 417/269 |
| 4,484,659 | 11/1984 | Buchwalder | 181/266 |
| 4,715,790 | 12/1987 | Iijima et al. | 417/269 |
| 4,744,737 | 5/1988 | Yamamura | 418/55.1 |
| 4,761,119 | 8/1988 | Nomura et al. | 417/269 |
| 4,815,358 | 3/1989 | Smith | 417/222 S |
| 4,836,754 | 6/1989 | Ikeda et al. | 417/269 |
| 4,904,165 | 2/1990 | Fraser | 417/312 |
| 4,973,230 | 11/1990 | Da Costa | 417/312 |

*Primary Examiner*—Richard A. Bertsch
*Assistant Examiner*—Peter Korytnyk
*Attorney, Agent, or Firm*—Ronald L. Phillips

[57] ABSTRACT

A variable displacement refrigerant compressor includes a plurality of axially reciprocating pistons connected to a non-rotary wobble plate. A drive shaft supplies a rotational input to axially reciprocate the pistons within their respective cylinders. Gaseous refrigerant is admitted to each cylinder through a suction valve and discharged from each cylinder through a discharge valve. Each discharge valve opens to a common discharge cavity, wherein one fluid outlet provides egress for all refrigerant discharged from each of the cylinders. A variable restriction attenuator is disposed in the discharge cavity. The attenuator includes a first orifice having a movable valve member biased into sealing engagement therewith. The attenuator also includes at least one second orifice through which discharge fluid bypasses the movable valve member and first orifice and flows directly to the fluid outlet. The movable valve member may be either a spherical ball, poppet or flapper type valve.

4 Claims, 4 Drawing Sheets

REFRIGERANT COMPRESSOR HAVING VARIABLE RESTRICTION PRESSURE PULSATION ATTENUATOR

TECHNICAL FIELD

The subject invention relates to a refrigerant compressor having a discharge pressure pulsation attenuator, and more particularly to a refrigerant compressor having a variable restriction discharge pressure pulsation attenuator disposed in the discharge cavity for attenuating dynamic pressure pulsations in the discharge cavity.

BACKGROUND ART

An inherent characteristic of a refrigerant compressor, such as used in an automotive air conditioning system, is the generation of dynamic pressure fluctuations, or pulsations, due to the dynamics of the compression process and interaction of the gaseous refrigerant flow between the cylinders in the compressor. These pressure pulsations have the undesirable effect of exciting certain components in the automotive air condition system, as well as components in the vehicle structure, which result in objectionable noise and/or vibration. Also, the vibrating and rattling components are prone to more rapid wear and premature failure.

The prior art attempts to solve this problem by installing a pressure pulsation muffler in the discharge conduit extending from the compressor to the air conditioning condenser. However, the in-line mounted mufflers are expensive and require considerable additional space.

The prior art also teaches that pressure pulsations may be attenuated by enlarging the volume of the compressor discharge plenum, or cavity, which, due to the expansion characteristics of refrigerant gas, will act to absorb some of the pressure pulsations. However, this prior art attempt to alleviate the pressure pulsation problem is also undesirable because an enlarged discharge cavity for the refrigerant compressor requires additional space and significantly increases the cost of the compressor.

Further, as perhaps best illustrated in the U.S. Pat. No. 4,715,790 to Iijima et al, issued Dec. 29, 1987, the prior art has attempted to alleviate the pressure pulsation problem by adding a gas flow restriction within the discharge cavity. The restriction comprises a reduced size orifice through which the refrigerant gas is required to flow. At low compressor operating speeds, where the pressure in the discharge cavity is relatively low, this method works satisfactorily. However, the disadvantage of this method of pulsation attenuation becomes highly evident at high compressor operating speeds. During high speed operation, the added pressure drop in the discharge cavity due to the orifice significantly increases the discharge pressure within the charge cavity. In fact, the pressures in the discharge cavity become so high at high operating speeds that the critical limit of the surrounding materials is often approached, thereby significantly reducing the durability of the compressor.

SUMMARY OF THE INVENTION AND ADVANTAGES

A compressor assembly of the type for compressing a circulating refrigerant fluid. The assembly comprises a compression chamber, a suction valve for admitting fluid to the compression chamber, a discharge valve for discharging fluid from the compression chamber, and a condenser for condensing refrigerant gas into liquid downstream of the discharge valve. The improvement of the subject assembly comprises an attenuator means disposed between the condenser and discharge valve for automatically adjusting the restriction to fluid flow therethrough in response to pressure variations upstream of the attenuator means to attenuate dynamic pressure pulsations in the discharge cavity and thereby reduce vibration of the compressor assembly.

The subject assembly solves the pressure pulsation problem existing in the prior art compressor assemblies by providing the attenuator means which automatically adjusts the restriction to fluid flow therethrough response to upstream pressure variations, or differences in the pressures upstream and downstream of the attenuator means. Therefore, at low pressures upstream of the attenuator means, the attenuator means provides a given restriction to fluid flow therethrough to attenuate the dynamic pressure pulsations, and at high pressures upstream of the attenuator means, the attenuator means automatically adjusts to a different fluid flow restriction to tailor the attenuation of pressure pulsations accordingly.

In this manner, as distinguished from the prior art, at high compressor speeds, when high pressures are generated, the attenuator means will not increase the pressures beyond the limit where the structural integrity of the components will be placed in jeopardy. Hence, in this manner, compressor durability will be maintained. Conversely, at low pressures upstream of the attenuator means, when dynamic pressure pulsations are most damaging, the attenuator means will automatically adjust itself to a greater restriction to fluid flow therethrough to more fully attenuate the dynamic pressure pulsations, and thereby to reduce vibrations.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE FIRST EMBODIMENT OF FIGS. 1 AND 2

Figure 1:
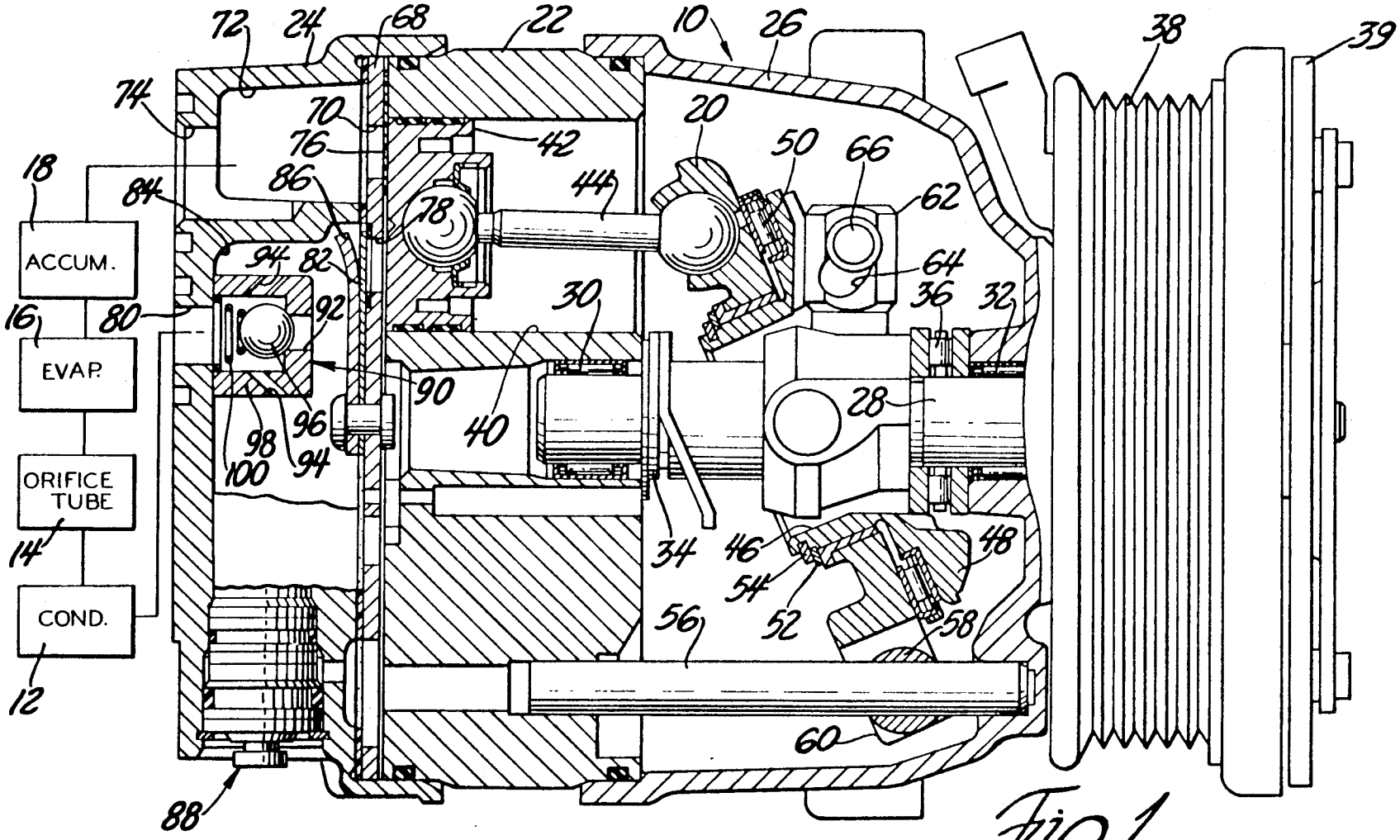
FIG. 1 is a cross-sectional view of a refrigerant compressor according to the subject invention including a first embodiment of the subject attentuator means disposed in the discharge cavity, and a schematic representation of an automotive air conditioning system in fluid communication with the suction inlet and discharge outlets of the refrigerant compressor.
Figure 2:
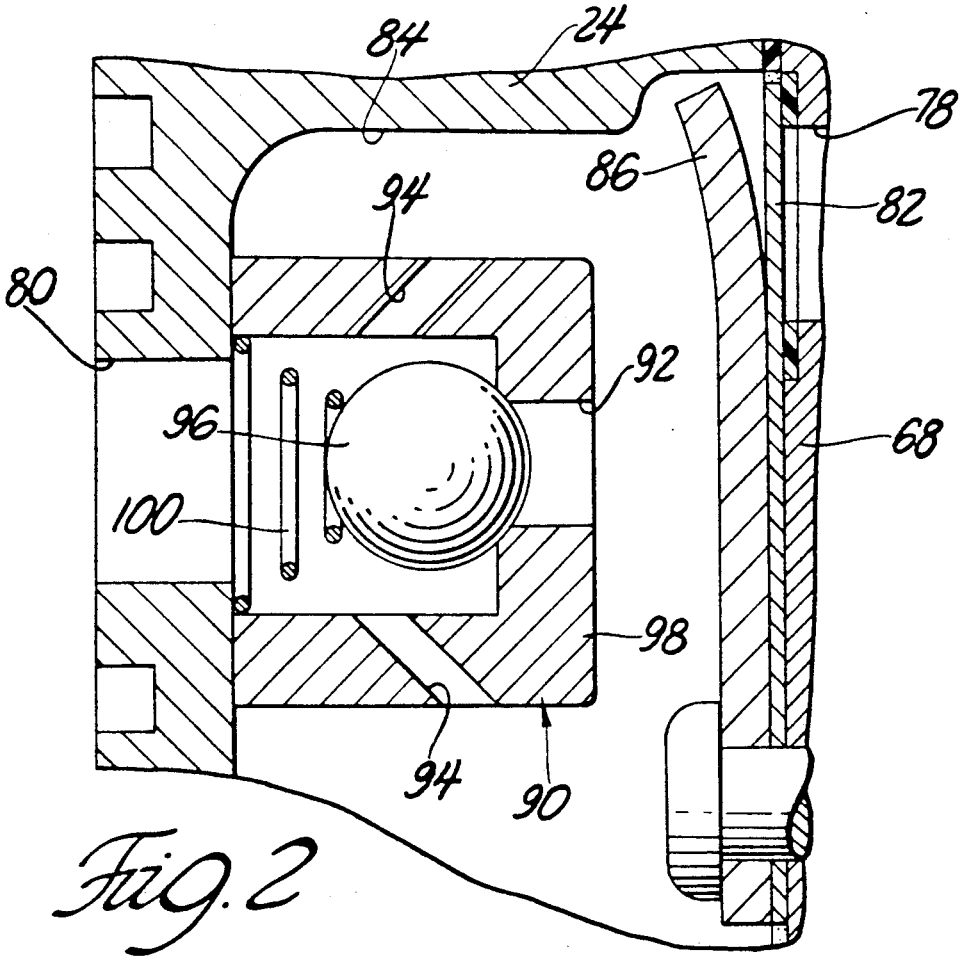
FIG. 2 is an enlarged fragmentary view of the first embodiment of the subject attenuator means as shown in FIG. 1.

Referring to FIGS. 1 and 2, wherein like numerals indicate like or corresponding parts throughout the several views, a refrigerant compressor is generally shown at 10 in FIG. 1. The compressor 10 is of the type for compressing a recirculated refrigerant fluid in an automotive air conditioning system having the normal condenser 12 for condensing refrigerant gas into a liquid, orifice tube 14, evaporator 16 and accumulator 18 arranged in that order between the compressor 10 discharge and suction sides.

The compressor 10 as shown in FIG. 1 is preferably of the variable displacement type having a variable angle wobble plate 20. The compressor 10 includes a cylinder block 22 having a head 24 and a crank case 26 sealingly clamped to opposite ends thereof. A drive shaft 28 is supported centrally within the cylinder block 22 and the crank case 26 by radial needle bearings 30, 32, respectively. The drive shaft 28 is axially retained in place by a thrust washer 34 adjacent the needle bearing 30, and a thrust bearing 36 adjacent the needle bearing 32. A pulley 38 is disposed on the end of the drive shaft 28 extending outwardly from the crank case 26 for operative connection to the automotive engine. An electromagnetic clutch 39 selectively engages and disengages the pulley 38 from the drive shaft 28.

The cylinder block 22 includes a plurality, e.g., five, axial cylinders, or compression chambers, 40 spaced in equal angular increments about the block 22, and equal radial increments from the axis of the drive shaft 28. A piston 42 is slideably disposed in each compression chamber 40. A piston rod 44 connects the back side of each piston 42 to the wobble plate 20. The piston rod 44 is retained at each end to the respective piston 42 and wobble plate 20 in known fashion.

The wobble plate 20 is of the non-rotary type and is mounted at its inner diameter on a journal 46 of a rotary drive plate 48. The wobble plate 20 is axially and rotatably retained upon the journal 46 of the rotary drive plate 48 at one end by a thrust bearing 50, and at the other end by a thrust washer 52 and a snap ring 54. The drive plate 48 is pivotally and slideably connected at its journal 46 to the drive shaft 28 in known fashion to permit angular movement of the drive plate 48 and the wobble plate 20 relative to the drive shaft 28. The wobble plate 20 is fixed to the drive plate 48 in such a manner so as to allow angular movement of the wobble plate 20 with the drive plate 48 relative to the drive shaft 28, while allowing the wobble plate 20 to remain non-rotary. Accordingly, a guide pin 56 is press-fit on opposite ends thereof in the cylinder block 22 and the crank case 26, parallel to the drive shaft 28. A ball guide 58 is slideably mounted on the guide pin 56 and retained on a fork extension 60 from the wobble plate 20.

A drive lug 62 extends radially outwardly from the drive shaft 28 for drivingly connecting the drive shaft 28 and the rotary drive plate 48. The drive lug 62 includes a guide slot 64 for guiding the angular movement of the drive plate 48 and the wobble plate 20 relative to the drive shaft 28. A cross pin 66 is slideably disposed within the slot 64 and retains an ear (not shown). The drive lug 62 arrangement for the drive plate 48 and the antirotation guide arrangement for the wobble plate 20 are like that disclosed in greater detail in U.S. Pat. Nos. 4,175,915 and 4,297,085, respectively assigned to the assignee of this invention and which are hereby incorporated by reference.

A valve plate 68 is fixedly clamped between the head 24 and the working end of the cylinder block 22. A suction inlet 70 is associated with each of the compression chambers 40 and generally comprises an opening through the valve plate 68. The head 24 is provided with a suction cavity, or chamber, 72 which is connected through an external port 74 to receive gaseous refrigerant from the accumulator 18, downstream of the evaporator 16. A suction valve 76 of the reed, or flapper, type is disposed over the suction inlet 70 for emitting fluid to the compression chamber 40 as the piston 42 moves through its intake stroke.

Similarly, a discharge outlet 78 is provided as an opening through the valve plate 68 for each of the compression chambers 40. The discharge outlet 78 is connected through an external port 80 to expel compressed gaseous refrigerant from the compression chamber 40 to the condenser 12. A discharge valve 82 of the reed, or flapper, type is disposed over the discharge outlet 78 for discharging fluid from the compression chamber 40 to the condenser 12. The head 24 is provided with a discharge cavity 84 in fluid communication with each of the discharge outlets 78 of each of the compression chambers 40. A back-up strap 86 is disposed in the discharge cavity 84 adjacent each of the discharge valves 82 for limiting the extent of opening of each of the discharge valves 82.

A variable displacement control valve arrangement, generally indicated at 88, is disposed in the head 24 and functions in response to discharge pressure within the discharge cavity 84 to control the angle of the wobble plate 20 relative to the axis of the drive shaft 28 in order to vary the displacement of each of the pistons 42 within their respective compression chambers 40. The variable displacement control valve 88 and associated structure is similar to that disclosed in greater detail in U.S. Pat. No. 4,428,718, assigned to the assignee of this invention, and which is hereby incorporated by reference.

According to the subject invention, an attenuator means, generally indicated at 90 in FIGS. 1 and 2, is disposed in the discharge cavity 84 for automatically adjusting the restriction to fluid flow through the discharge cavity 84 in response to pressure variations in the discharge cavity 84 to attenuate dynamic pressure pulsation in the discharge cavity 84 and thereby reduce vibration of the compressor assembly 10. The attenuator means 90 includes a first orifice 92, also disposed in the discharge cavity 84, between the discharge valve 82 and the external port 80, for directing gaseous refrigerant through the discharge cavity 84. The attenuator means 90 also includes a second orifice 94 disposed in the discharge cavity 84, between the discharge valve 82 and the external port 80, for directing fluid through the discharge cavity 84. The attenuator means 90 is structured so that the first orifice 92 and the second orifice 94 form an exclusive path through the discharge cavity 84 from the respective discharge valves 82 to the single external port 80. That is, fluid exiting the compression chambers 40 must pass through either of the first 92 or second 94 orifices in order to reach the external port 80.

The attenuator means 90 further includes a movable valve member 96 which is biased into fluid sealing engagement with the first orifice 92. The valve member 96 automatically decreases the resistance to refrigerant flow through the discharge cavity 84 in response to increasing fluid pressures upstream of the valve member 96 in the discharge cavity 84 to attenuate the dynamic pressure pulsations within the discharge chamber 84. More particularly, the attenuator means 90 includes a valve body 98 comprising a generally cap-shaped member having a U-shaped cross section as shown in FIGS. 1 and 2. The valve member 96 is disposed over the external port 80 with the valve member 96 captured therein. The valve member 96 is a generally spherical-shaped member which engages a matingly shaped seat in the valve body 98. A biasing member 100 is disposed in the valve body 98 and urges, or biases, the valve member 96 into fluid sealing engagement with the seat in the valve body 98 to close the first orifice 92.

The second orifice 94 comprises a plurality of obliquely extending passages disposed through the valve body 98 which are not blocked to flow therethrough by the valve member 96. Therefore, the second orifice 94 provides a fluid bypass in a path around the valve member 96. This has the effect of providing an uninterrupted flow passage through the discharge cavity 84 even when the valve member 96 is sealingly engaged over the first orifice 92.

The attenuator means 90 has been described in the preferred embodiment wherein it is disposed in the discharge cavity 84. However, it will be appreciated that the attenuator means 90 may alternatively be located anywhere between the condenser 12 and the discharge valve 82. For example, the attenuator means 90 may be installed on the exterior surface of the head 24, at the outlet of the external port 80. Or, the fluid carrying conduit between the external port 80 and the condenser 12 may be several and the attenuator means 90 installed there.

Figure 5:
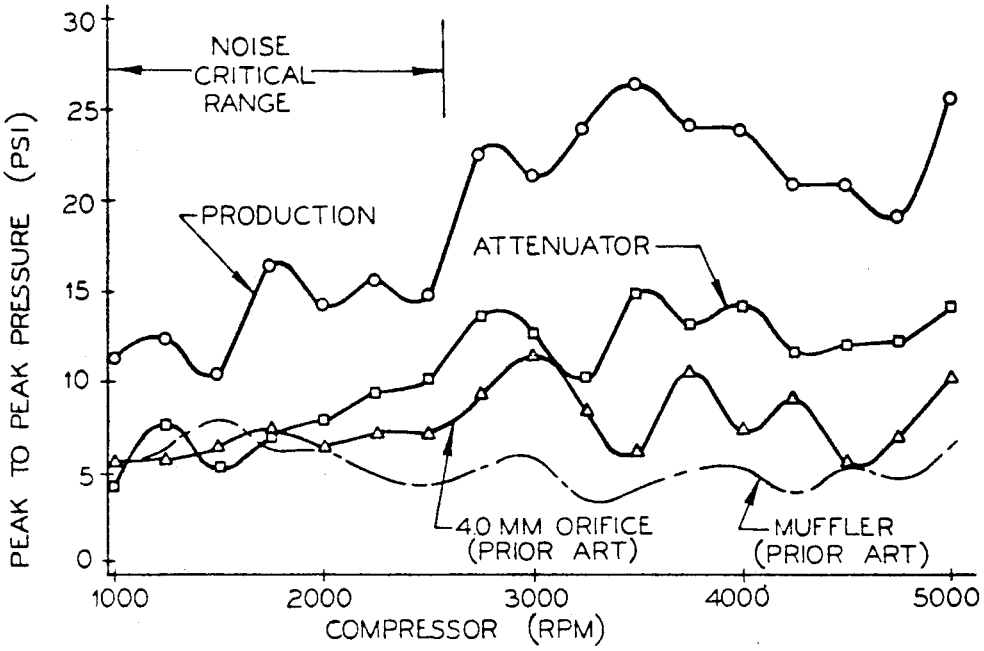
FIG. 5 is a graph illustrating an operating characteristic of the subject invention.
Figure 6:
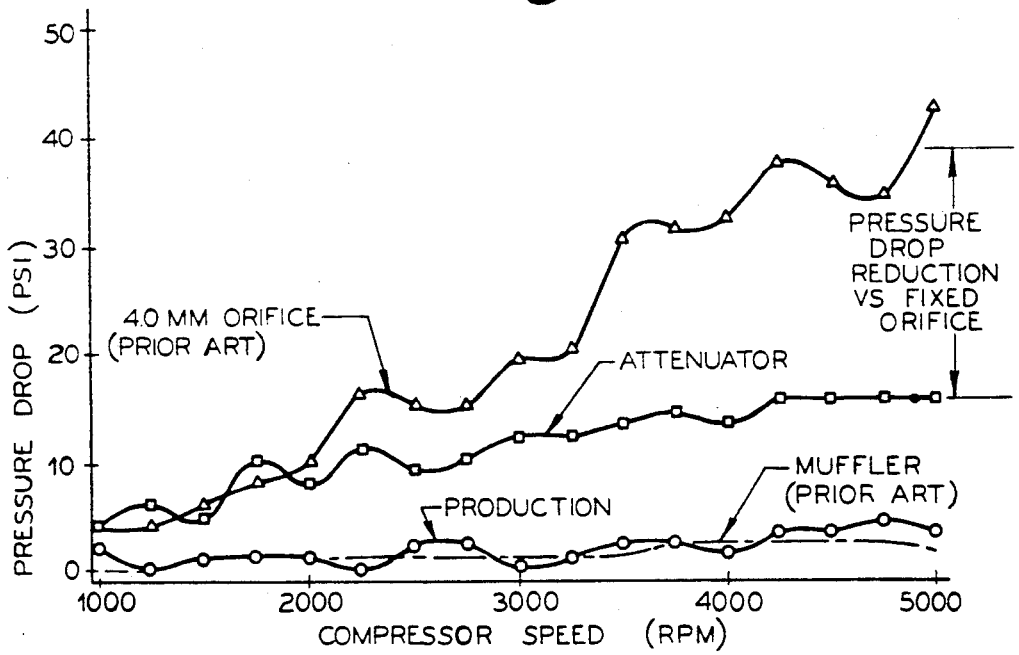
FIG. 6 is a graph illustrating an operating characteristic of the subject invention.

In operation, and referring also to FIGS. 5 and 6, it will be appreciated that the lower the operating speed, i.e., lower drive shaft 28 RPM, the lower the pressure in the discharge cavity 84. However, it is in the lower pressure range where the greatest fluctuations in dynamic pressure pulsations occur. These dynamic pressure pulsations cause vibration of the compressor 10, as well as vibration of other components, resulting in unwanted noise and potentially damaging the vibrating components. Yet at higher pressures, the pressure pulsations are not as traumatic. Therefore, less attenuation of the pulsations is required at higher operating speeds.

Accordingly, at low pressures the movable valve member 96 of the attenuator means 90 remains sealed against the seat in the valve body 98 to close the first orifice 92, thereby causing movement of the fluid through the discharge cavity 84 to pass through the second orifice 94. The small diameter of the second orifice 94 acts as a gas flow restriction and is quite effective in attenuating the dynamic pressure pulsations. However, as pressure in the discharge cavity 84 increases with increased operating speeds to a predetermined pressure, and less attenuation is required, the movable valve member 96 begins to move against the urging of the biasing member 100 to open the first orifice 92 and allow the gaseous refrigerant to also flow through the first orifice 92. In other words, the refrigerant pressure upstream of the valve member 96 increases past the predetermined pressure, the valve member 96 moves further away from its seat in valve body 98, and hence further away from the first orifice 92, to allow more fluid to flow through the first orifice 92 and thereby reduce the flow restriction through the discharge cavity 84. Therefore, as will be appreciated, the subject invention overcomes the deficiencies in the prior art by providing by the attenuator means 90 which automatically decreases the flow restriction through the discharge cavity 84 as the pressure inside the discharge cavity 84 reaches and then surpasses a predetermined pressure.

FIG. 5 illustrates an operating characteristic of the subject invention in comparison to the prior art attenuators and an unattenuated compressor. In this graph, an unattenuated "production version" compressor is illustrated by circular data points, whereas the subject invention is illustrated by square data points, the prior art orifice (4.0 mm diameter) is illustrated by triangular data points and the prior art muffler is illustrated by a broken line. The "Peak To Peak Pressure" recorded along the abscissa of the graph reflects the difference in pressure pulsations produced by the compressor 10. That is, the pressure pulsations are defined by the pressure differential between the high peak and the low peak pressures. According, if there were no pressure pulsations, a zero peak-to-peak pressure would be recorded. It will be seen that from approximately 1000 RPM to 2500 RPM the compressor will produce the greatest dynamic pressure pulsations in the discharge cavity 84, known as the "Noise Critical Range". It is in this area that the movable valve member 96 of the attenuator means 90 remains closed in order to attenuate the undesirable pulsations.

FIG. 6 illustrates the pressure drop within the discharge cavity 84 between the discharge valve 82 and the external port 80. As shown, the pressure drop in the discharge cavity for the unattenuated "production version" is practically zero because there is no attenuator disposed within the discharge cavity. Likewise, the prior art muffler exhibits practically zero pressure drop in the discharge cavity because the prior art muffler is not disposed within the discharge cavity, but in-line of refrigerant flow conduit. FIG. 6 illustrates the dramatic pressure drop caused by the prior art 4.0 mm orifice. As will be observed, the prior art orifice works well at low operating speeds, but causes significantly increased pressure buildups at higher operating speeds. The subject invention is shown in FIG. 6 as causing some pressure increase within the discharge cavity 84, but significantly less than that caused by the prior art 4.0 mm orifice.

DETAILED DESCRIPTION OF THE ALTERNATIVE EMBODIMENT OF FIG. 3

Figure 3:
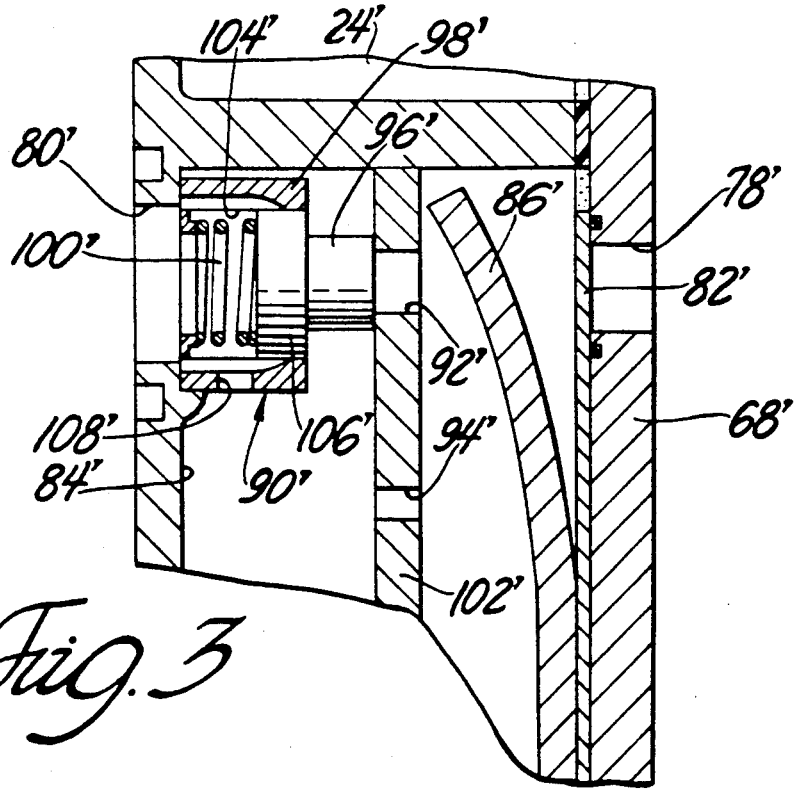
FIG. 3 is a fragmentary cross-sectional view of a second embodiment of the subject attenuator means.

FIG. 3 illustrates an alternative embodiment of the subject invention. To facilitate description, like reference numerals with a single prime designation are used to indicate like parts.

In the embodiment shown in FIG. 3, a baffle plate 102' is disposed in the discharge cavity 84' to isolate the external port 80' of the discharge cavity 84' from the discharge outlet 78'. The first orifice 92' is disposed in the baffle plate 102'. Similarly, the second orifice 94' is also disposed in the baffle plate 102'. The attenuator means 90' includes a moveable valve member 96' disposed for axial reciprocating movement in a valve body 98'. A biasing member 100' is disposed in the valve body 98' for urging the valve member 96' toward a valve seat on the baffle plate 102' for fluidly sealing the first orifice 92'. The inner surface of the valve member 98' includes a plurality of internal flutes, or grooves, 104' which do not extend the entire length of the valve body 98'. The valve member 96' includes an enlarged head portion 106' slidingly engaging the flutes 104'. When the valve member 96' is engaged over the first orifice 92', as shown in FIG. 3, fluid may not pass between the enlarged head portion 106' and the valve body 98'.

A third orifice 108' is disposed radially through the valve body 98' and cooperates with the second orifice 94' for providing an uninterrupted flow path from the discharge outlets 78' to the external port 80'. Therefore, at low operating pressures in the discharge cavity 84', gaseous refrigerant is directed into the discharge cavity 84', through the second orifice 94' in the baffle plate 102', and then through the third orifice 108' to the external port 80'. However, as fluid pressures increase in the discharge cavity 84', the movable valve member 96' is urged against the biasing member 100' to open the first orifice 92' to flow therethrough. As the enlarged head portion 106' moves into the fluted region 104' of the valve body 98', refrigerant is permitted to pass around the valve member 96' and between the flutes 104' to exhaust through the external port 80'.

DETAILED DESCRIPTION OF THE SECOND ALTERNATIVE EMBODIMENT OF FIG. 4

Figure 4:
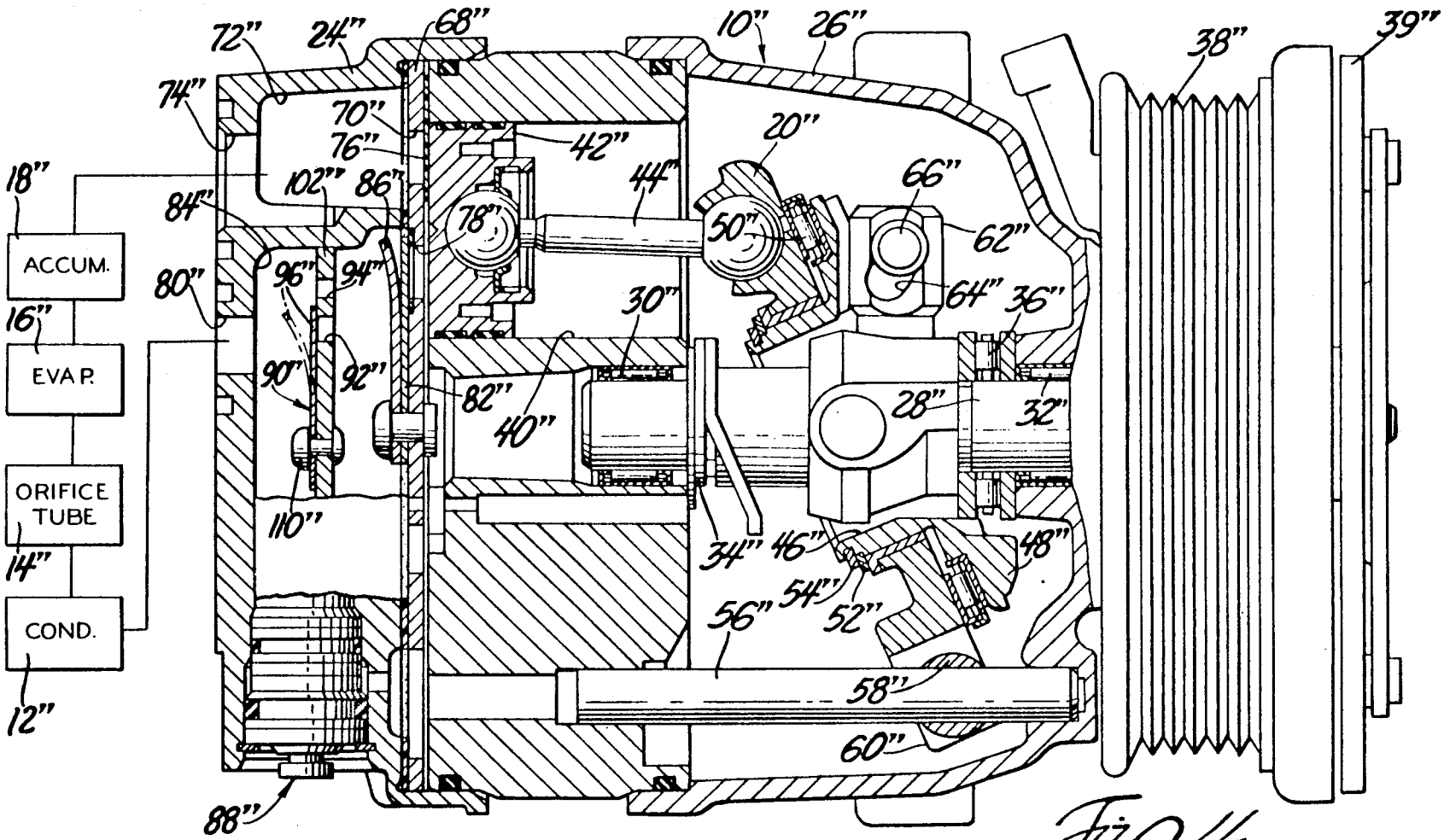
FIG. 4 is a cross-sectional view of a refrigerant compressor as in FIG. 1, and including a third embodiment of the subject attenuator means.

Yet another alternative embodiment of the subject invention is shown in FIG. 4. Again, to facilitate description, like numerals with a double prime designation are used to indicate like parts.

In FIG. 4, a compressor 10'' is shown substantially identical to the first embodiment in FIG. 1. A discharge cavity 84'' is provided to receive discharge from each of the compression chambers 40'' before exhausting the compressed refrigerant through the external port 80'' to the condenser 12''. A baffle plate 102'' is disposed in the discharge cavity 84'' to isolate the discharge outlet 78'' from the external port 80''. A first orifice 92'' is disposed in the baffle plate 102''. Similarly, a second orifice 94'' extends through the baffle plate 102''. A movable valve member 96'' is provided comprising a reed, or flapper, type valve. The movable valve member 96'' is fixed to the baffle plate 102'' by a rivet 110'' so as to support the valve member 96'' in cantilever fashion sealingly engaging over the downstream side of the first orifice 92''.

During low speed operation of the compressor 10'', fluid pressures in the discharge cavity 84'' are not great enough to displace the valve member 96''. As a result, the gaseous refrigerant is forced through the second orifice 94'' to the external port 80''. During this low speed operation, the dynamic pressure pulsation attenuation is accomplished by the flow restriction provided by the second orifice 94''. However, as pressures increase with increased compressor speed, attenuation becomes less critical and the valve member 96'' is flexed to the position shown in phantom in FIG. 4 to allow flow through the first orifice 92''. This additional flow through the first orifice 92'' significantly reduces the restriction to fluid flow through the discharge cavity 84'' and does not thereby adversely effect the compressor 10''.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

What is claimed is:

1. A compressor assembly of the type for compressing a recirculated refrigerant fluid, comprising:

a compression chamber;

a suction valve for admitting fluid to said compression chamber;

a discharge valve for discharging fluid from said compression chamber;

a discharge cavity having a fluid inlet at said discharge valve and a downstream fluid outlet;

the improvement comprising a first orifice disposed in said discharge cavity between said discharge valve and said fluid outlet for directing fluid through said discharge cavity, a movable valve member biased into fluid sealing engagement with said first orifice for opening said first orifice to flow therethrough in response to a predetermined pressure upstream of said valve member in said discharge cavity, and a second orifice disposed in said discharge cavity between said discharge valve and said fluid outlet for directing fluid through said discharge cavity in a path around said valve member to provide an uninterrupted fluid flow through said discharge cavity at pressures below said predetermined pressure.

2. A compressor assembly of the type for compressing a recirculated refrigerant fluid, comprising:

a compression chamber;

a suction valve for admitting fluid to said compression chamber;

a discharge valve for discharging fluid from said compression chamber;

a discharge cavity having a fluid inlet at said discharge valve and a downstream fluid outlet;

the improvement comprising a valve body disposed in said discharge cavity about said fluid outlet and having a first orifice, a moveable valve member disposed in said valve body for sealingly engaging said first orifice, a biasing member disposed in said valve body for biasing said valve member into fluid sealing engagement with said first orifice, and a second orifice disposed in said valve body for directing fluid to said fluid outlet in a path around said valve member to provide an uninterrupted fluid flow through said discharge cavity when said valve member is sealingly engaged with said first orifice.

3. A compressor assembly of the type for compressing a recirculated refrigerant fluid, comprising:

a compression chamber;

a suction valve for admitting fluid to said compression chamber;

a discharge valve for discharging fluid from said compression chamber;

a discharge cavity having a fluid inlet at said discharge valve and a downstream fluid outlet;

the improvement comprising a baffle plate disposed in said discharge cavity to isolate said fluid inlet from said fluid outlet and including a first orifice disposed therethrough and a second orifice disposed therethrough, and a movable valve member biased into fluid sealing engagement with said first orifice for adjusting the restriction to fluid flow through said first orifice in response to pressure variations in said discharge cavity upstream of said first orifice to attenuate dynamic pressure pulsations in said discharge cavity and thereby reduce vibration of said compressor assembly.

4. A compressor assembly of the type for compressing a recirculated refrigerant fluid, comprising:

a compression chamber;

a suction valve for admitting fluid to said compression chamber;

a discharge valve for discharging fluid from said compression chamber;

a discharge cavity having a fluid inlet at said discharge valve and a downstream fluid outlet;

the improvement comprising a baffle plate disposed in said charge chamber to isolate said fluid inlet from said fluid outlet and including a first orifice disposed therethrough and a second orifice disposed therethrough, and a cantilever valve member sealingly engaging said first orifice for adjusting the restriction to fluid flow through said first orifice in response to variations in said discharge cavity upstream of said orifice to attenuate dynamic pressure pulsations in said discharge chamber and thereby reduce vibration of said compressor assembly.

* * * * *